US005160076A

United States Patent [19]

Ford

[11] Patent Number: 5,160,076

[45] Date of Patent: Nov. 3, 1992

[54] TICKET DISPENSING DEVICE AND METHOD

[75] Inventor: Ronald K. Ford, San Diego, Calif.

[73] Assignee: Donald Sutherland, San Diego, Calif. ; Trustee of the Ralph L. Evans Trust

[21] Appl. No.: 492,650

[22] Filed: Mar. 13, 1990

[51] Int. Cl.[5] ..... B26F 3/02

[52] U.S. Cl. ..... 225/4; 225/32

[58] Field of Search ..... 225/4, 5, 10, 11, 12, 225/13, 14, 15, 32, 106, 100; 83/242

[56] References Cited

U.S. PATENT DOCUMENTS

| | | | |
|---|---|---|---|
| 961,075 | 6/1910 | Hirsch | 225/52 |
| 1,339,823 | 5/1920 | Harbaugh | 225/52 |
| 1,813,935 | 7/1931 | Knee . | |
| 2,657,750 | 11/1953 | Webb | 225/32 |
| 2,865,699 | 12/1958 | Fitzgerald | 225/11 |
| 3,627,183 | 12/1971 | Mason | 225/96.5 |
| 3,935,978 | 2/1976 | Arp et al. | 225/15 |
| 4,032,004 | 6/1977 | Coates | 206/39.6 |
| 4,094,451 | 6/1978 | Wescoat | 225/96 |
| 4,140,259 | 2/1979 | Kostka et al. | 225/16 |
| 4,157,670 | 6/1979 | Herring | 83/165 |
| 4,272,001 | 6/1981 | Horniak | 226/187 |
| 4,716,799 | 1/1988 | Hartmann | 83/42 |
| 4,738,384 | 4/1988 | Tigner | 225/16 |
| 4,858,806 | 8/1989 | Schafer | 225/32 |
| 4,982,337 | 1/1991 | Burr et al. | 364/479 |

*Primary Examiner*—Mark Rosenbaum
*Assistant Examiner*—John M. Husar
*Attorney, Agent, or Firm*—Gregor N. Neff

[57] ABSTRACT

The ticket dispenser is usable to dispense a wide variety of tickets, but is particularly beneficial in dispensing lottery tickets, and other tickets stored in panels in fan-folded stacks. The leading edge of the ticket panel is thrust against a curved guide which serves as a barrier. This causes the lead ticket to bend along a perforation line and be thrust out of the outlet of the ticket dispenser at an angle to the rest of the panel. The rest of the panel is held firmly, and the ticket easily can be torn free on the perforated line along which the panel is bent. A swinging gate is provided for closing the outlet opening and swinging away to permit bending of the ticket panel, and pushing and/or guiding the ticket through the outlet opening. The dispenser is fast, simple, compact and accurate, and does not cut tickets in half, and yet does not permit strips of tickets to be pulled out of the machine by the user who has not paid for them. A ticket vending machine is formed when one or more dispensers are combined with a bill acceptor. The vending machine will dispense a wide variety of tickets from a single unit.

22 Claims, 6 Drawing Sheets 11
11
64
102
90
112
114
160
92
62
103
136
88
108
135
134
89
154
164
162
116
152
126
128
105
106
107
109

TICKET DISPENSING DEVICE AND METHOD

This invention relates to ticket dispensing devices and methods, and particularly to ticket vending machines. More particularly, the invention relates to lottery ticket dispensing and vending machines and methods.

In dispensing tickets from ticket dispensing and vending machines, there are special problems. The machine should deliver the number of tickets for which the customer pays, and it should not cut or mutilate the tickets. It should be particularly reliable in operation, and it should not allow the customer to pull tickets out of the machine without paying for them.

There are especially difficult problems with some tickets, such as lottery tickets, which are relatively large, thick and stiff. The instant-winner type of ticket, in which the purchaser scratches off a covering material to reveal whether he or she has won a prize, presents special difficulties.

Such tickets usually are supplied in panels with the tickets separated from one another by perforation lines, and the tickets are supplied preferably in a stack of fan-folded panels. Such tickets are unusually difficult to feed accurately and tear apart. Therefore, many prior ticket dispensers have resorted to cutting the tickets apart.

Prior ticket-cutting dispensing machines suffer from the disadvantage that any inaccuracy in the feeding results in a ticket which is cut in half or mutilated, to the great aggravation of the customer and the vending entity.

In the past, others have attempted to solve these problems by providing mechanisms which "burst" the tickets apart along the perforated lines, rather than cutting them apart, and closely monitoring the movement of the ticket panels to attempt to accurately separate the tickets along the perforated lines. One such prior device is shown in U.S. patent application Ser. No. 128,070, filed Dec. 13, 1987, now U.S. Pat. No. 4,982,337 in the name of Robert L. Burr, et al. While such a device has advantages over prior devices, the device tends to be more complex and expensive to manufacture, and less reliable in operation than is desired.

The dispensing mechanism of the above-identified prior patent application has been used with some success in a multiple ticket-vending machine which will accept bills and issue a number of tickets corresponding to the amount paid by the customer. Advantageously, the tickets are moved past a window as they are being dispensed so that the customer can see the tickets through the windows, both before and while they are being dispensed. That vending machine is shown in U.S. patent application Ser. No. 312,111, filed Feb. 17, 1989, in the name of Robert L. Burr.

The problem of complexity, size, and cost of manufacturing of the dispensing mechanisms become considerably more severe when multiple dispensing mechanisms are incorporated in the same vending machine.

Accordingly, it is one object of the present invention to provide a ticket dispensing device and method which are particularly simple, compact, and inexpensive to manufacture. It also is an object of the invention to provide such a device and method which are relatively simple and reliable in operation, and require relatively little maintenance.

It is a further object of the present invention to provide such a device and method in which ticket mutilation is minimized, and in which it is very difficult for tickets to be removed without the customer paying for them. It is a another object to provide such a device and method which can be used readily with a wide variety of tickets of varying size and thickness.

It is yet another object of the invention to provide a ticket vending machine, and particularly a lottery ticket vending machine, which will accept currency or other means of economic exchange, and issue corresponding numbers of tickets. It is an object to provide, in particular, a multiple-ticket vending machine with multiple windows and different tickets behind the windows, so that a customer can see and select among a substantial number of different tickets to purchase The foregoing objects are met, in accordance with the present invention, by the provision of a ticket dispensing device and method in which a ticket strip or panel is bent through a substantial angle along a perforated line, and one or more tickets ahead of the bend are projected out of an opening in the machine housing. The remaining tickets in the panel are held inside the machine so that the customer can grasp the projecting ticket or tickets and easily tear them free of the remaining tickets in the panel.

Preferably, a tearing barrier is provided in the machine, and the bent perforation is held closely adjacent to an edge of the barrier so that the projecting ticket or tickets can be pulled against the barrier to facilitate tearing.

It also is preferable that a curved guide be provided, and means are provided for thrusting the ticket panel longitudinally against the guide so as to cause it to buckle and bend. Then, when the angle of the lead ticket has changed sufficiently due to the bending, the ticket is ejected through the outlet opening in the dispensing machine.

It also is preferable that a gate be provided to move to the outlet opening to block it, and away from the opening where it provides a surface to urge and guide the ticket out of the outlet while it is being pushed forward by the feed mechanism. Preferably, the gate means is swung back towards the outlet opening to push the ticket out and hold the remaining tickets in the panel firmly in place to facilitate tearing.

The result of the invention is that tickets are almost invariably torn only along perforations, so that tickets are not cut or torn in two or mutilated. Furthermore, the mechanism is greatly simplified because no power-driven means are needed to cut or burst the tickets apart; instead, the customer supplies the tearing power and the mechanism which otherwise would be needed is eliminated.

Moreover, it is made easy for the customer to tear the tickets along the correct perforation line because the ticket is bent first along the perforation line and is held in the bent position until it is torn. The bending not only weakens the material of the ticket stub at the perforation, but it clearly and accurately defines the line along which the ticket is to be torn.

The dispensing mechanism of the invention is particularly beneficial due to its compact size and simplicity when used in a multiple-window ticket vending machine constructed in accordance with the present invention. Because they are more compact, more dispensing mechanisms can be housed in the same size housing, at a considerably lower cost than in the past.

The foregoing and other objects and advantages of the invention will be set forth in or apparent from the following description and drawings. In the drawings.

GENERAL DESCRIPTION

Figure 1:
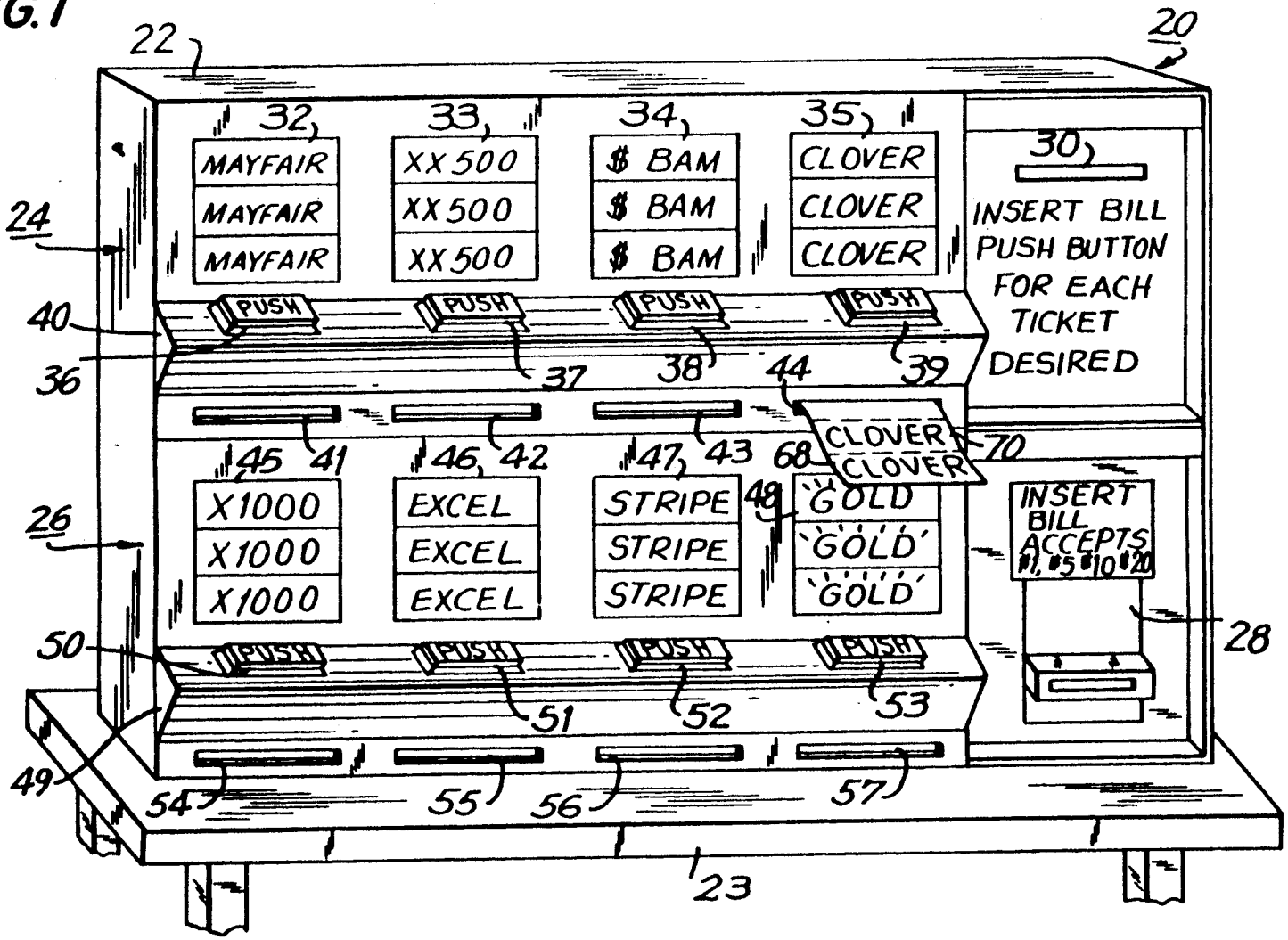
FIG. 1 is a perspective view of a multiple ticket lottery ticket vending machine constructed in accordance with the present invention.

FIG. 1 shows a lottery ticket vending machine 20 utilizing the present invention. The machine 20 includes a housing 22, two rows 24 and 26 of windows displaying different lottery tickets, a bill acceptor 28, and a message display 30.

The top row 24 of windows includes four windows 32–35, four corresponding push-buttons 36–39 mounted in a projecting panel 40, and four corresponding dispensing openings or slots 42–44. Two instant-winner lottery tickets 68 and 70 are shown issuing from the slot 44.

The bottom row 26 of windows includes four windows 45–48, four push-buttons 50–53 in a panel 49, and four dispensing slots 54–57.

When purchasing tickets from the machine 20, the purchaser can see each of the eight different tickets through the windows and can read the legends and the prize information contained on the tickets. When the purchaser has selected the ticket to purchase he or she inserts a $1.00, $5.00, $10.00 or $20.00 bill in the bill acceptor 28, and pushes the appropriate one of the eight buttons to select which type of ticket is to be dispensed. The tickets then automatically are issued from the slot for the selected ticket.

If more than one ticket is purchased, the tickets are issued in groups. That is, for example, if the customer inserts a five dollar bill and each of the tickets costs one dollar, a panel of five tickets will be dispensed. The customer then grasps the ticket group, pulls on it, and tears the group of tickets off.

If he or she then wishes to select a different ticket, the same procedure is repeated for the different ticket and a different push-button is pushed to select the desired tickets.

As the tickets are being dispensed, the ticket panels move downwardly past the windows so that the customer can see the tickets moving.

It should be understood that a vending machine constructed in accordance with the present invention can have any number of dispensing windows and mechanisms desired, such as one, two, four, six, or eight or more.

DISPENSING MECHANISM

Figure 2:
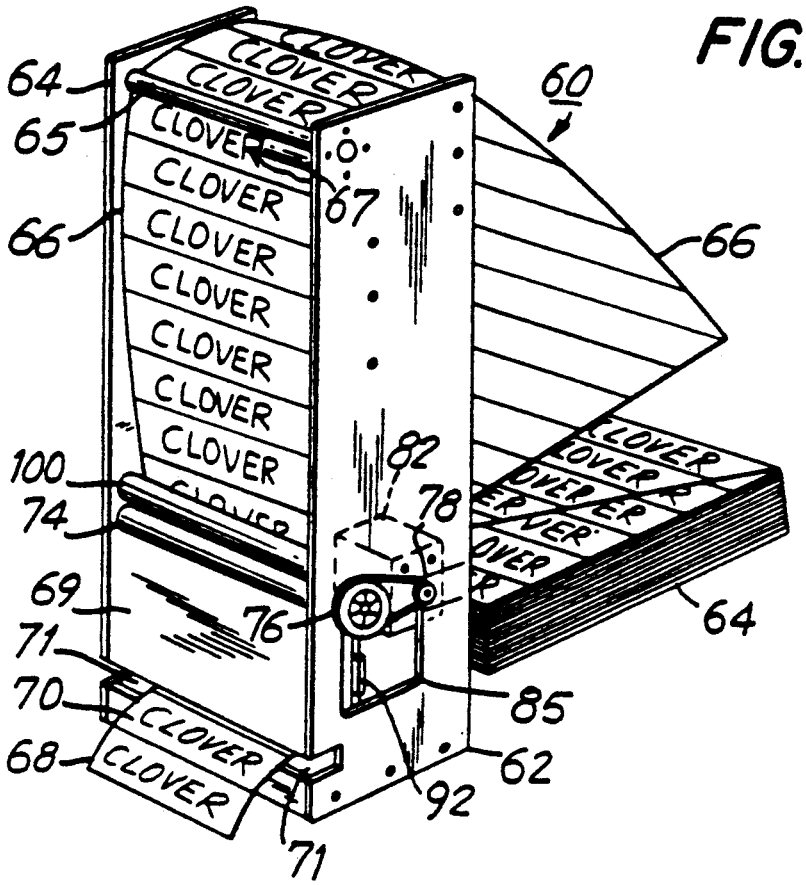
FIG. 2 is a right-side perspective, partially schematic view of a ticket dispensing mechanism constructed in accordance with the present invention.

FIG. 2 is a perspective view of a dispensing mechanism 60 constructed in accordance with the present invention. One such dispenser is located behind each of the windows in FIG. 1. The device 60 includes a housing having a pair of side panels 62 and 64 with internal spacers providing transverse support, and a front panel 69 with an outlet slot with an outlet opening 71.

Fan-folded panels of lottery tickets 66 are stored in a pile 64 in the housing. The panels of tickets are pulled upwardly from the pile 64, over the top of the unit 60, between a pair of relatively soft guide rollers 65 and 67, and vertically downwardly. The vertical array of tickets is covered by the transparent material of one of the windows when used in a vending machine like the one shown in FIG. 1.

The panel of tickets is driven downwardly by a main feed roller 102 (see FIG. 4, not shown in FIG. 2) operating against an idler 74. The feed roller 102 is driven by a sprocket 76 and a chain 80 driven by a small sprocket 78 which is driven by a stepping motor 82. The stepping motor is shown in dashed outline in FIG. 2 and is housed in the housing of the dispensing mechanism.

Figure 4:
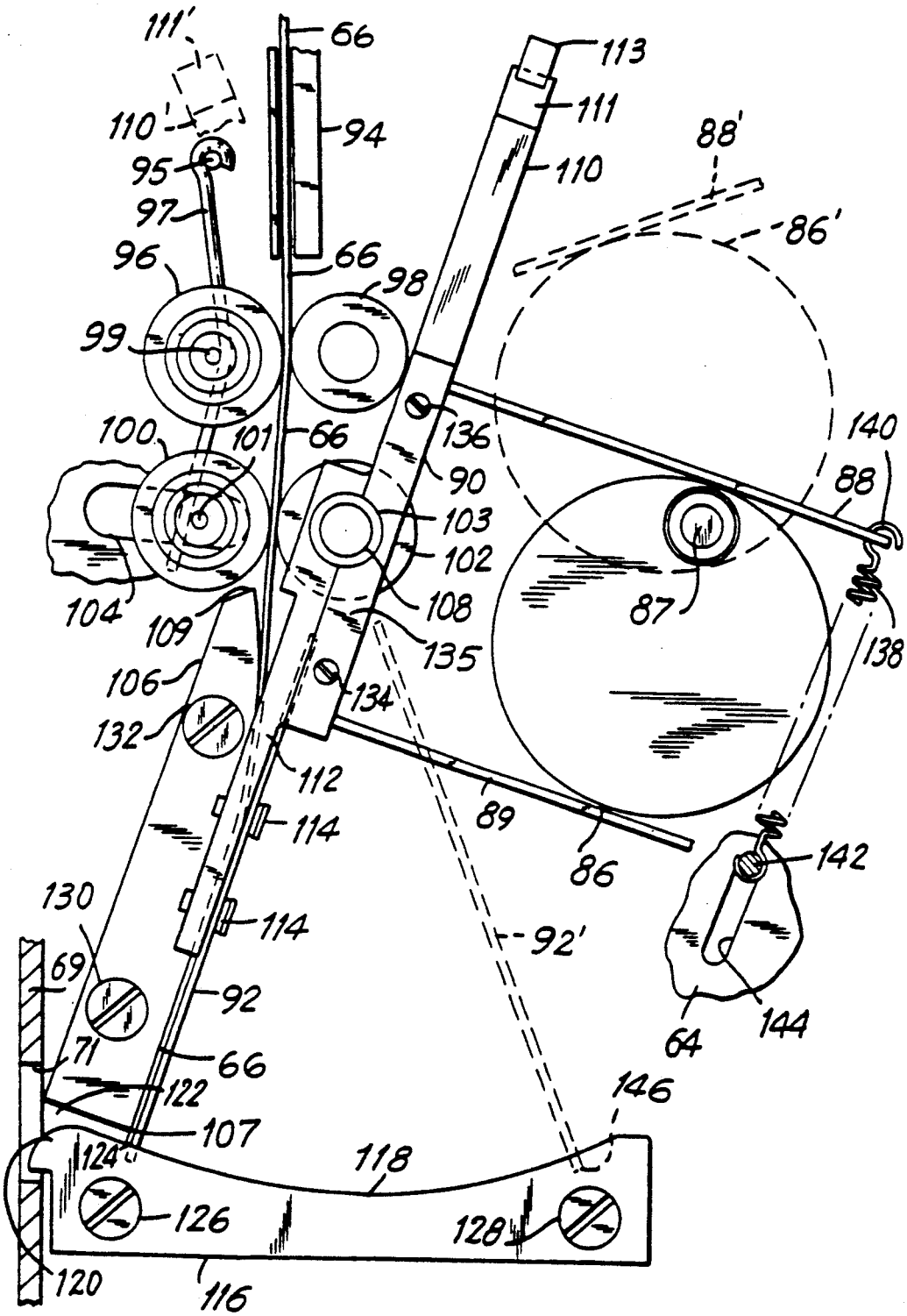
FIG. 4 is a side-elevation, partially schematic view of the internal construction of the ticket dispensing device shown in FIGS. 2 and 3.

Now referring to FIG. 4, the main feed roller 102 which is driven by the motor 82 of FIG. 2 is mounted to rotate on bearings 108 (also see FIGS. 8 and 11) which are force-fitted into holes in the side panels 62 and 64. The feed roller 102 mates with an idler roller 100.

The strip or panel 66 of tickets is driven downwardly by the roller 102 between edge guides 94 which are positioned on opposite sides 62 and 64 of the housing of the ticket dispensing device, and move between a pair of rolls 96 and 98. Roll 98 is an optional imprinter roll which imprints information on the rear surface of each ticket. Such information can include the vending location, a vendor's name, or other such information. Roller 96 is an idler.

The panel 66 is fed downwardly over a guide member 106 which has a top edge 109, a curved upper surface, and a sharp tearing edge 107. The guide member is inclined at an angle to vertical.

Figures 8, 9, 11:
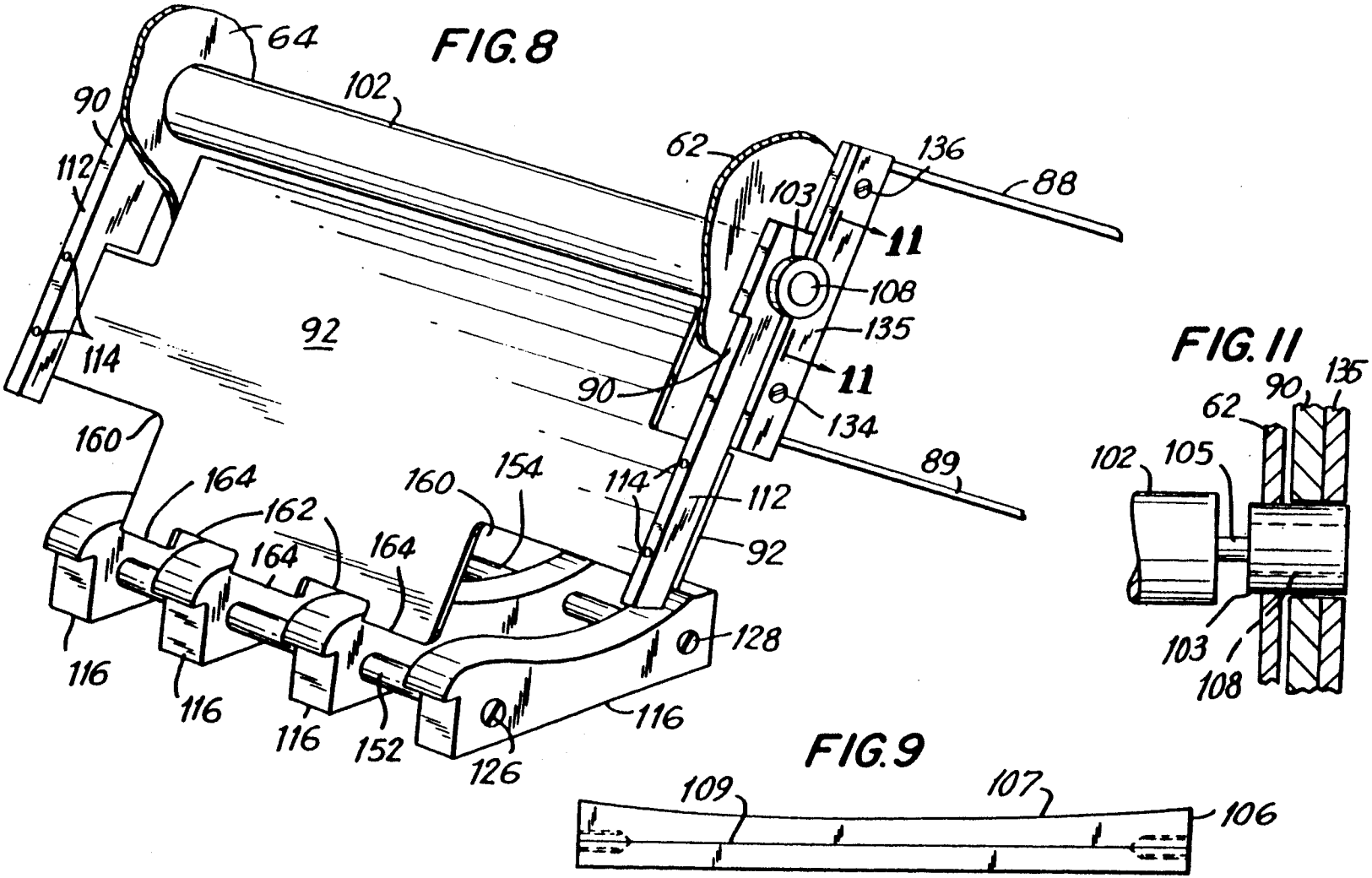
FIG. 8 is a perspective, partially broken-away view of a portion of the mechanism shown in FIGS. 2 through 4.
FIG. 9 is a top-plan view of a ticket-tearing barrier of the device shown in FIGS. 2 through 4.
FIG. 11 is a partially cross-sectional broken-away view taken along line 11—11 of FIG. 8.

The lower or leading edge 124 of the ticket panel abuts against the front portion of the curved upper surface 118 of each of four guide members 116 (see FIG. 8). Only one guide member 116 is shown in FIG. 4.

The guide members 116 are arranged so that the front edge of each is spaced from the bottom edge of the barrier member 106 to leave a relatively thin gap 122 between the two members. The sharp lower edge 107 of the barrier member 106 serves as a tearing edge against which tickets are torn loose. Tickets are issued outwardly through the gap 122 and the outlet opening 71 in the front panel 69 of the dispensing mechanism.

GATE MECHANISM

A gate mechanism is shown in FIG. 4. The gate mechanism includes a gate panel 92 which is secured by fasteners 114 to the lower portion 112 of a gate arm 90. Actually, as it is shown in FIG. 8, there are two of the gate arms 90. Each is rotatably mounted on the outer surface of the bearing 108 which mounts the drive roller 102 in the housing. The gate panel holds the gate arms in place. Thus, the gate mechanism can swing freely about the axis of the feed roller 102.

As it is shown in FIG. 8, the four guide members 116 are held together by screws 126 and 128 driven into the threaded ends of support rods 152 and 154 Which pass through holes in each of the four guide members. The guide members 116 preferably are made of a plastic material such as Delrin. The upper surface 118 of each is smooth.

In FIG. 4, two alternative drive mechanisms for the gate are shown. For ease of illustration, they are both shown in FIG. 4 as if they were inside the housing of the dispensing mechanism, whereas actually they are outside of the housing.

One drive mechanism includes a cam 86 secured to a shaft 87. The cam bears against cam follower arms 88 and 89.

Figure 3:
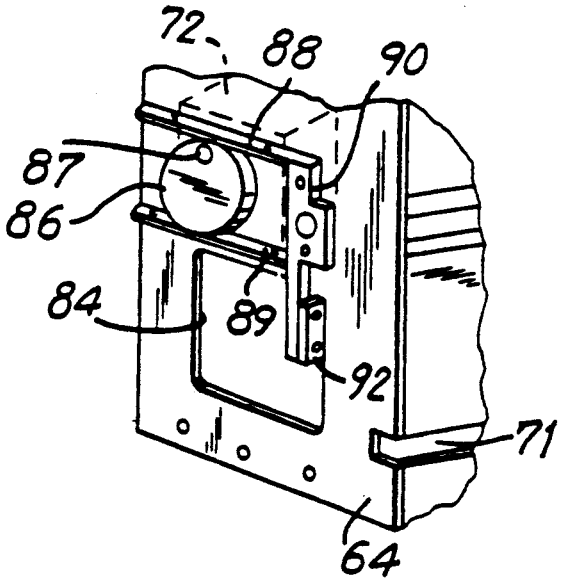
FIG. 3 is a left-side perspective, partially broken-away view of the device shown in FIG. 2.

As it is shown in FIG. 3, the shaft 87 is driven by a stepper motor 72. The cam 86 and the cam follower arms 88 and 89 actually are outside the housing of the dispensing mechanism. FIGS. 2 and 3, as well as FIG. 8, show that the gate arms 90 extend outside of the housing through holes 84 and 85 in the side panels 64 and 62.

A second alternative drive means is a spring 138 attached to the arm 88 at one end and secured at 142 to a fastener which is adjustably mounted in a slot 144 in the wall 64 to adjust the spring tension. It should be understood that the spring 138 and the cam 86 need not be used together, but are alternative forms of drive means for the gate mechanism. In one embodiment of the invention, the spring 138 is used to close the gate, and the cam to open it. Otherwise, the cam and spring are alternative means for operating the gate.

As it is shown in FIG. 3, one end of the gate panel 92 moves back and forth in the large opening 84 in the left side panel 64 of the device 60. The stepping motor 72 is shown in dashed outline. It rotates shaft 87 to drive the cam 86 and lift the follower arms up and let them down.

The cam follower structure is shown in FIGS. 4 and 8, as well as in FIG. 3. For ease of illustration, it is shown in FIGS. 4 and 8 as if it were attached to the right side of the dispenser mechanism rather than the left side.

As it is shown in FIGS. 4 and 8, the follower includes a base bar 135 which is fastened by screws 134 and 136 to the gate arm 90. The bar 135 has a central semi-circular cut-out to fit over the bearing surface 103. The arms 88, 89 are steel rods threaded at one end into holes in the base bar 135.

The operation of the gate when driven by the cam mechanism is as follows. Referring again to FIG. 4, the gate mechanism is shown in solid lines all the way to the left in its "home" position where it blocks the outlet gap 122 through which tickets are issued. The follower 88 and the cam 86 are shown in solid lines in the positions they have when the gate is thus closed.

In order to open the gate and swing the gate panel 92 to the right-most position 92' shown in dashed lines in FIG. 4, the cam is rotated to the position shown in dashed lines 86', at which it has lifted the follower arm 88 to the position 88' shown in dashed outline.

An upper extension arm 110 is attached to the arm 90 and has a thin blade 111 which passes between the lamp and photocell of a photodetector 113 which produces an electrical signal when the gate reaches its home position.

Rotation of the cam 86 through another half revolution forces the lower follower arm 89 down to return the gate to its starting position.

In the embodiment of the invention in which the spring 138 is used as the return means to close the gate instead of the cam, the gate is opened by the force of each bending ticket which pushes it to the right and rotates the gate mechanism counterclockwise to open it.

The slot 144 makes it possible to secure the fastener 142 at varying positions in the slot to vary the spring tension to accommodate tickets of varying thickness and weight. This is an optional feature which may be needed when tickets of relatively thin paper are being dispensed.

The thin paper may not be stiff enough to push the gate open against the rather heavy spring tension needed to close the gate when tickets of stiffer, heavier materials are dispensed. Therefore, lower spring tensions can be used to enable the tickets to push the gate open.

A third means of driving the gate is a hybrid of the foregoing. Only follower arm 88 is used. The cam 86 rotates to open the gate, and the spring 138 closes it. The cam 86 is moved axially or returned to its starting position very rapidly in order to allow the spring 138 to do its work.

The cam drive has the advantage that it positively opens the gate every time, whereas the material of the tickets may not be up to the task all the time.

The spring drive has the advantage that it is simple and inexpensive.

The hybrid drive uses the best features of both; the positive drive of the cam to open the gate, and the smoothness of operation resulting from using the spring return instead of the fluttering drive of the cam drive stepping motor.

The drive roller 102 has a polyethylene surface of about 55 shorr durometer hardness for good drive traction. The idlers 96 and 100 are made of aluminum. Idler 100 is biased towards drive roller 102 by a very simple spring bias device. Two short pieces 97 of 0.055 diameter piano wire are used as springs, one at each end of the roller 100 (only one spring 97 is shown in FIG. 4). One end of each wire is wrapped around a post 95 projecting from one of the side walls 62 and 64. The wire then is bent to bear against axles 99 and 101 of idlers 96 and 100 to provide spring thrust against the axle of the idler 100. Each spring thus provides around two pounds of thrust, for a total of four pounds of thrust to hold the idler 100 tightly against the feed roller 102 and grip the tickets firmly.

The thrust provided by this arrangement can be varied simply by changing the diameter of the piano wire.

TICKET DISPENSING ACTION

Figure 5:
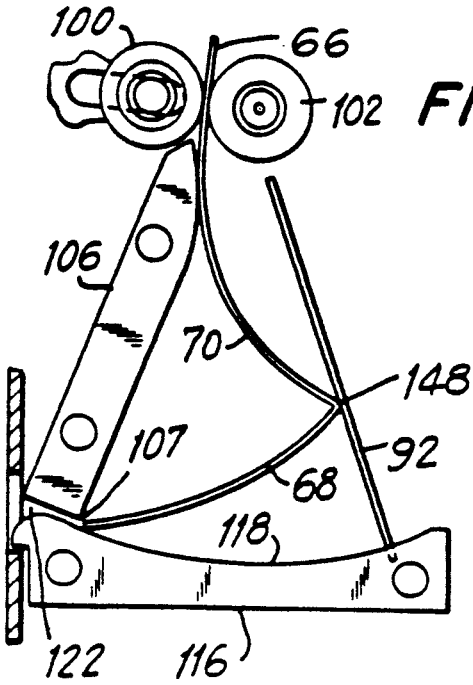
FIGS. 5, 6 and 7 are simplified side-elevation views, similar to that of FIG. 4, showing the ticket dispensing mechanism at various different times during the dispensing of tickets.
Figure 6:
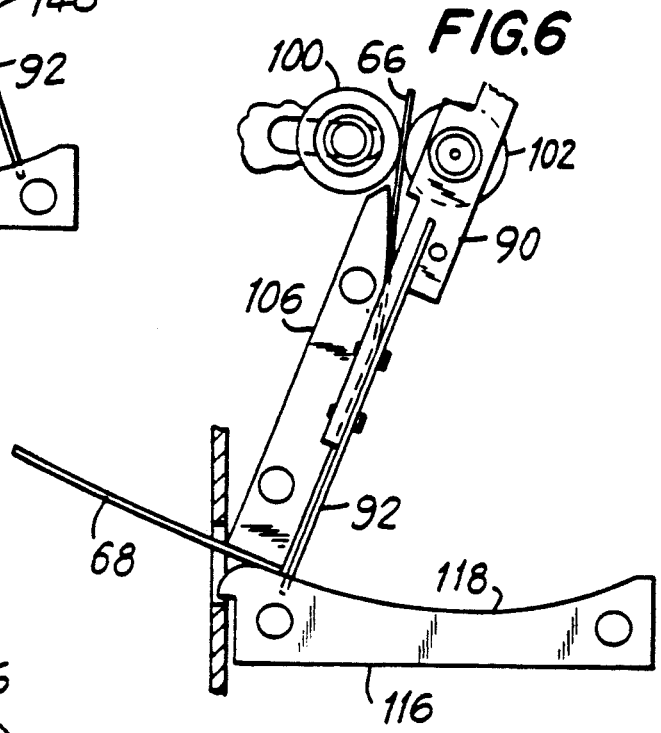
Figure 7:
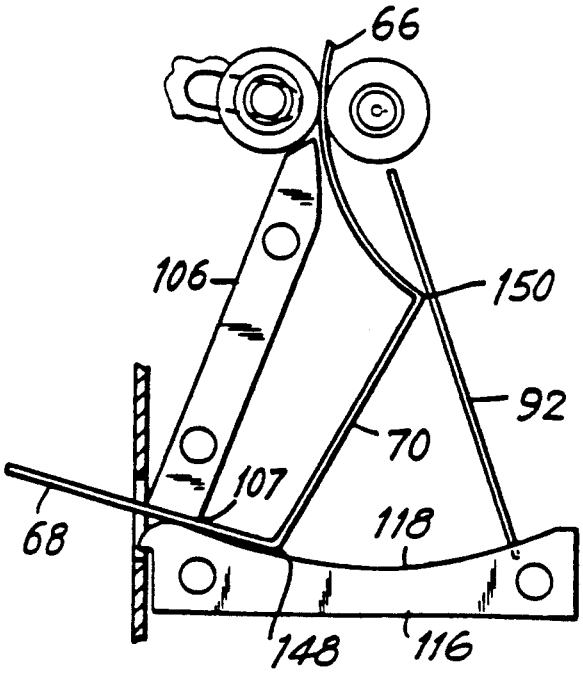

The mechanism shown in FIG. 4 also is shown, in simplified form, in FIGS. 5, 6 and 7 at different positions during the dispensing of tickets. The ticket dispensing operation starts with the panel of tickets 66 in the position shown in FIG. 4, with its leading edge 124 abutting against the curved upper surface of the guide members 116, at a point near the outlet 122.

Upon receiving instructions to issue a ticket, the drive roller 102 rotates and forces the ticket panel downwardly. The gate then proceeds to open and move to the right (counterclockwise), under either the pushing force of the ticket material itself (in the case where the spring 138 alone operates the gate), or by the action of the cam 86 which is being driven by the stepping motor 72 shown in FIG. 3.

FIG. 5 shows what has happened after the ticket panel has been driven downwardly by a distance somewhat less than the width of one ticket. As it is shown in FIG. 4, the ticket panel in its initial position is bent slightly to the right by the curvature of the guide member 106.

Further downward drive motion by the feed roller 102 causes the ticket panel to buckle and bend along the line of weakest resistance, namely, the first perforation line, thus forming a corner 148 at the point where the ticket panel is bent. This corner 148 bears against the panel 92 which is now in its right-most position as shown in FIG. 5, and causes the lead ticket 68 to be bowed somewhat as shown. The upward curvature of the left ends of the curved surfaces 118 of the guide members 116, and the greatly altered angle of the lead ticket 68, now direct the lead edge of the ticket into the gap 122. As the drive roller 102 continues to push the ticket panel downwardly, the leading edge of the ticket 68 slips into the gap 122 and is pushed outwardly through the outlet opening of the machine.

As this happens, either the tension of the spring 138 urges the gate panel 92 towards the left, or the cam 86 performs the same function, so as to push the ticket 68 out through the outlet opening until the gate has returned home, to the position shown in FIG. 6.

In this position, the panel of tickets is held firmly in place, whereas the bend 148 of the ticket is snugly fitted up against the sharp edge 107 of the barrier member 106, with the lead ticket and the panel being at about 90 degrees angle relative to one another. It then is an easy matter for the customer to grasp the protruding ticket 68, pull it outwardly, tear the ticket free along the perforated line 148.

When issuing a series of tickets, the same procedure is followed repeatedly the proper number of times to issue the proper number of tickets. For example, the same procedure is repeated ten times if the customer buys ten tickets, and the customer can tear off the strip of ten tickets when the machine is finished dispensing. Thus, the cutting or tearing of each ticket is avoided. This saves time and wear and tear on the dispenser.

In accordance with one of the advantageous features of the invention, if, during the issuing of a string of tickets, the customers should pull on the tickets already issued before the dispensing operation is complete, the customer can tear off the tickets already issued. The dispensing of the remaining tickets in the batch he has paid for then will be completed. This is because each separate ticket dispensing motion operates independently of whether the ticket leading or ahead of the tearing point has been torn off or remains in place.

It also is an advantage of the invention that because the gate 92 holds the remaining tickets in the panel firmly against the barrier 106, it is very difficult, if not totally impossible, for the customer to pull a continuous string of tickets out of the machine which he or she has not paid for. If he does this, he will normally come away with the number of tickets that he has paid for, not more. The gate will close and the pulling will tear the tickets free. This minimizes the chances of successful theft or vandalism.

In accordance with an optional operating feature of the invention, it is possible to issue a string of tickets without operating the gate mechanism for each individual ticket. This can speed the issuance of serial tickets, and reduce the wear and tear on the mechanism.

As shown in FIG. 7, after the first ticket 68 has moved to a position in which it is part-way out of the outlet opening, the continued feeding of the ticket panel causes the panel to bend at the next perforation line 150. The corner 150 bears against the stationary gate panel 92 and forces the corner 148 to move upwardly along the curved guide and out all the way to the gap 122 so that the bend 148 is adjacent the sharp edge 107. The corner 150 then slides downwardly along the barrier 92, and the second ticket 70 in the string then moves outwardly through the outlet opening.

Should the customer attempt to pull a string of tickets out of the machine at this time, he can do so only up to a point. The electronic control system of the invention counts each ticket as it is issued, so that his pulling a string of tickets will end with the gate mechanism 92 closing and preventing him from obtaining any more tickets than he has paid for.

It should be understood that the operation of the device shown in FIG. 7 uses the cam and cam follower to open the gate, rather than the ticket pressure on the spring 138.

It should be noted, as shown in FIGS. 4 and 8, that the lower edge of the gate panel 92 extends slightly below the curved surfaces of the guide members 116.

As shown in FIG. 8, the gate panel 92 has lower corner cut-outs 160 and notches 162 which form three short broad projections 164 which extend slightly into the spaces between adjacent guide members 116. This insures that the edge of a ticket will not accidentally slip into a gap or junction between the lower edge of the guide panel 92 and the guide members 116.

As shown in FIG. 9, which is a top plan view of the barrier member 106, the cutting edge 107 is concave. Thus, when the ticket corner or bend is brought up against it, and the customer pulls on the ticket, the tearing will start at one of the two edges of the ticket, rather than elsewhere. This promotes tearing cleanly along the perforation, and minimizes accidental tearing elsewhere.

CONTROL SYSTEM

Figure 10:
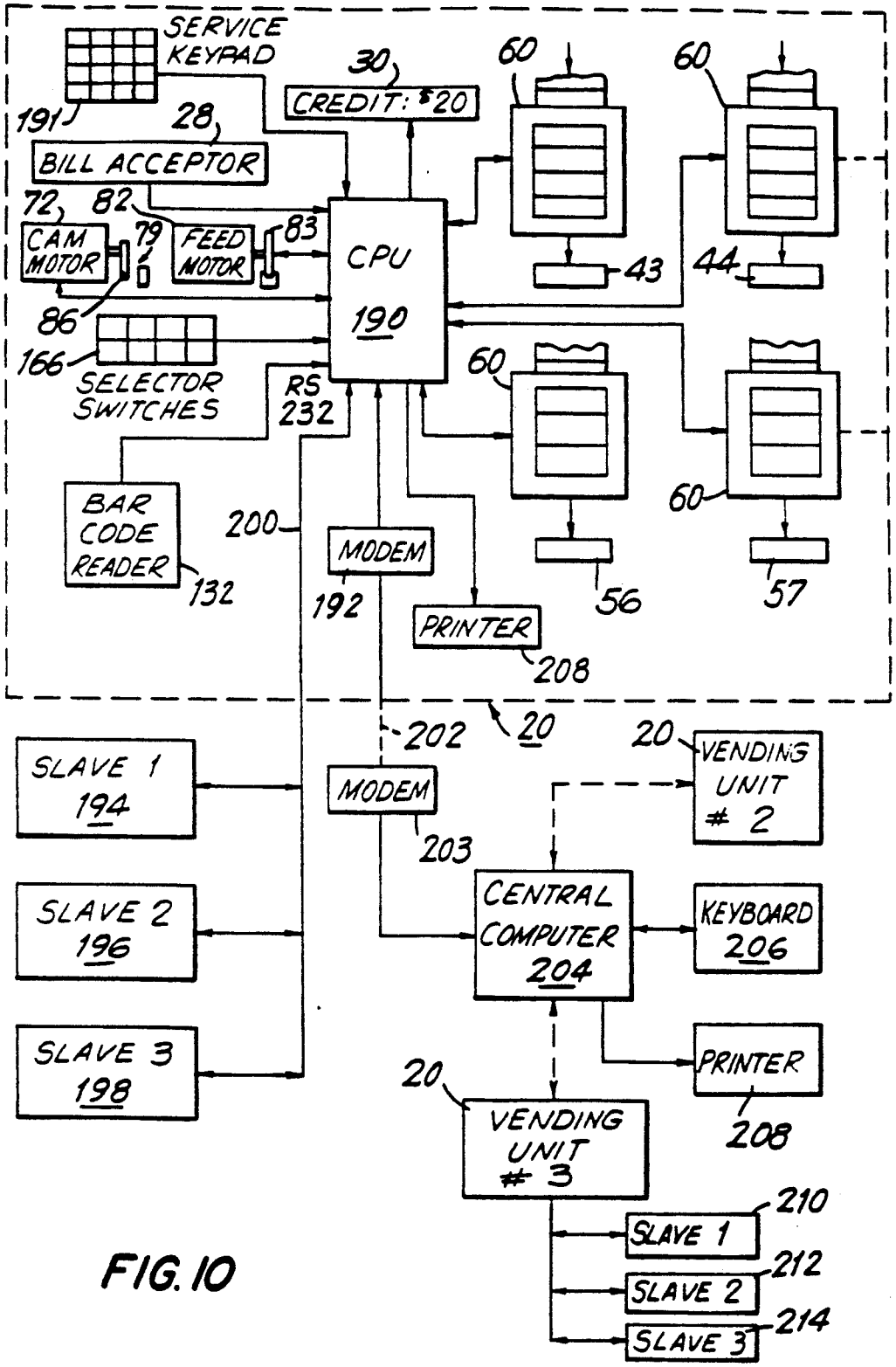
FIG. 10 is a schematic circuit diagram of an operating circuit of a vending machine and a computerized vending system using many vending machines such as the one shown in FIG. 1.

FIG. 10 shows a ticket vending system including a number of vending units 20 and a central computer 204.

Each unit 20 has a microprocessor whose CPU 190 is shown in FIG. 10. The bill receiver or acceptor 28 outputs a signal which indicates the denomination of the bill and its authenticity. The CPU computes the amount of credit due to the customer and displays it on the LED display 30 so that the customer knows how much credit he or she has at any given moment. The bill receiver is adapted to accept bills in denomination of $1.00, $5.00, $10.00 and $20.00 in U.S. currency, or other multiple denominations of the currency of other countries.

The selector switches 36-39 and 50-53 are shown as an array 166. A keypad can be used for ticket selection instead, if desired. The switch for the selected type of ticket then is operated by the customer to select one of the eight games available, and the bill receiver indicates the number of lottery tickets to be issued. This information is operated upon by the CPU 190 and is used to cause the proper number of tickets to be issued from the selected dispenser 60. (For ease of illustration, only four dispensers are shown in FIG. 10). Then the amount of credit shown on the display 30 is reduced by one unit as each ticket is issued so that the customer can see that he is being charged the proper amount for each ticket. The customer then can select other windows and other numbers of tickets, if desired.

Counting the number of tickets is done by counting the number of steps taken by the stepping motor 82 which drives the feed roll 102. For this purpose, stepping pulses are sent to the CPU 190 for counting.

Alternatively, if the gate mechanism opens and closes for the dispensing of every ticket, the number of pulses of the photodetector 113 (FIG. 4) can be counted to count the number of tickets dispensed. This has the advantage of not requiring the machine to store data regarding varying ticket lengths, and would not require changes for different ticket lengths.

When the cam 86 and follower arms 88 and 89 shown in FIGS. 3 and 4 are used to open and shut the gate, the microprocessor sends a signal to start the cam drive motor 72 when the ticket drive motor 82 (FIG. 2) is started. The cam drive motor stops when the microprocessor counts a pre-determined number of steps taken by the motor 72. Then, after a pre-determined number of steps of the ticket drive 82 motor has been counted, indicating a movement of the ticket panel 66 by a desired distance, the cam drive motor 72 is started again to close the gate. The motor 72 stops when the detector 113 detects that the gate has actually closed. The cycle then is repeated for the next ticket, until all tickets in the order have been dispensed.

Again referring to FIG. 10, the feed stepping motor 82 has a shaft position encoder 83 including a lamp and photocell detector cooperating with a disc with slits to give signals indicating the actual movement of the stepping motor. This is done to ensure that the drive motor actually moves the feed roller 102. When the feed roller has not moved, this is an indication that there is a jam in the machine and that service is required.

Similarly, a photodetector 79 detects and signals when the cam returns to its starting point.

Communication between the vending units 20 and the central computer 204 preferably is through telephone lines 202 by means of a modem 203, or an optional dial-up modem 192 in each of the units 10.

If desired, in order to save hardware costs and telephone charges, a group of four or more vending units can be operated in a master-slave relationship with one unit 20 being the master and three units 194, 196 and 198 being connected by cable as slaves to the master unit. In this manner, there is communication with the central computer only through the master unit. This reduces the number of telephone lines needed to one, and reduces hardware costs in the slave units. The master-slave groupings are convenient to use when multiple vending machine are located close to one another, as in a single building.

FIG. 10 shows, in the lower portion, another vending unit 20 with three slaves 210, 212 and 214. Still another vending unit 20 without any slaves is shown to the right and above the central computer 204 in FIG. 10.

A keyboard 206 and a printer 208 are connected to the central computer at the same location as the computer so that ticket agents can input and output the information necessary to control the vending units and check on their operation and security.

A printer 208 is located inside of each vending machine 20. Such a printer prints a record of all transactions and data regarding operation of the machine, and can be used by the agent servicing the machine for accounting and other purposes which have been disclosed in the above-identified co-pending patent applications.

One of the advantages of the invention is that, within wide limits, adjustments need not be made in the mechanism for tickets of different lengths. The mechanism shown in FIGS. 2–7 adjusts automatically to dispense tickets of a variety of different lengths. For example, ticket lengths between one inch and over two inches can be accommodated without adjustment.

A service keypad 191 is located internally in the housing of the vending machine 20 to facilitate servicing. If counting of tickets dispensed is done on the basis of accumulated length of tickets fed, then an adjustment can be input with the keypad 191.

The machine 20 optionally can have an electric advertising sign (not shown). The wording of the advertising sign can be changed at will, preferable from the central computer 204. It is typically a LED display. It can be stationary or moving, as is well-known in the art.

The programming of the microprocessor in the vending machine advises a customer by way of the display 30 when the mechanism dispensing a particular one of the game tickets is inoperative, and then will advise the customer to chose another game. The bill receiver or acceptor 28 will not accept any currency if all games are inoperative.

The specific circuitry and program routines used in the unit 20 are more fully described in the above-identified co-pending patent applications, and will not be elaborated upon here.

As it can be seen from the foregoing, the invention meets the objectives set forth above. The ticket dispensing mechanism is relatively simple and compact and inexpensive to manufacture. Yet it is fast-operating, and protects against unauthorized removal of tickets without payment. It accommodates different tickets of different thicknesses and lengths.

Because of the compactness of the dispensing mechanism, almost twice as many can be placed in one vending machine for lottery tickets. Furthermore, the simplicity of the mechanism makes it much less subject to malfunction and significantly reduces the need for service calls.

The mechanism reduces the incidence of ticket mutilation to a very low level. Furthermore, tickets are issued in strips, rather than singly, thus avoiding the need to sever every ticket from the next one. Yet, this is done without significant danger that the customer will be able to pull more tickets out of the machine then he has paid for.

The above-description of the invention is intended to be illustrative and not limiting. Various changes or modifications in the embodiments described may occur to those skilled in the art and these can be made without departing from the spirit or scope of the invention.

I claim:

1. A ticket dispenser for dispensing relatively stiff tickets from a panel in which said tickets are delineated from one another by lines of weakness, said dispensing means comprising, in combination, a housing for storing said tickets before dispensing them, said housing having an outlet opening, a tearing barrier in said housing adjacent said opening, dispensing means including drive means for frictionally driving said panel and forming a bend by bending said ticket panel along one line of weakness around said tearing barrier and pushing a ticket ahead of said line out through said opening to a position where it can be grasped and pulled to pull said strip against said tearing barrier while said bend is maintained and said tearing barrier is aligned with said one line.

2. A device as in claim 1, in which said panel is thrust in a first direction, guide means in said housing extending in said one direction to a position near said opening to guide tickets bearing against it through said opening, said drive means being adapted for moving said panel towards and against said guide means in a second direction transverse to said first direction to form said bend, and for pushing said first ticket through said opening.

3. A device as in claim 2, said drive means including pushing means and a pusher member, said pushing means being drivably coupled to said pusher member to push said lead ticket.

4. A device as in claim 3, in which said pushing means comprises a spring urging said pusher member towards said opening.

5. A device as in claim 1, including means responsive to payment received for causing said dispensing means to dispense a predetermined number of tickets corresponding to the amount of said payment.

6. A device as in claim 1, including gate means for selectively opening and closing said outlet opening, said tearing barrier having a tearing edge, said gate means being adapted to hold said panel against said barrier with one of said lines of weakness adjacent said tearing edge when said gate means is in position to close said opening.

7. A device as in claim 6, in which said gate means is mounted to be pivoted through a variable angle to a second position away from said opening in which it contacts said panel at said bend and deflects said lead ticket ahead of said bend towards said opening.

8. A device as in claim 1, in which said housing has a transparent window, and feed means for feeding said panels past said window towards said dispensing means so as to make the tickets visible from outside said housing.

9. A device as in claim 8, in which said housing has a plurality of said windows and one of said outlet openings adjacent each window, and one of said feed means and dispensing means for each of said windows.

10. A device as in claim 9, including an acceptor for a medium of payment, and means for selecting a window from which tickets are to be dispensed, and means controlled by said acceptor to cause the dispensing means associated with a selected window to issue the number of tickets corresponding to the amount of payment made.

11. A device as in claim 1 in which said tearing barrier has a concave tearing edge, whereby pulling said first ticket against said barrier edge helps ensure that tearing of said first ticket starts adjacent one edge thereof.

12. A ticket dispensing device for dispensing tickets from panels of tickets separable from one another along lines of weakness, said device comprising, in combination, a housing, means for holding a supply of said panels in said housing, bending means in said housing for bending said ticket panel along one of said lines of weakness, said housing having an outlet opening, a tearing barrier in said housing, drive means for frictionally driving said panel and issuing at least one ticket through said outlet opening with said panel bent along said line of weakness and said line of weakness adjacent said barrier, said one ticket extending through said opening at an angle to said panel and in a position to be grasped and pulled against said barrier to tear it loose from said panel.

13. A device as in claim 12, in which said issuing means is adapted to issue a plurality of said tickets, still fastened together in a group, and to bring the line of weakness at the trailing end of said group to said barrier to facilitate tearing said group of tickets free from said panel.

14. A method of dispensing tickets from a group of relatively stiff tickets fastened together along lines of weakness, said method comprising the steps of storing said tickets in a housing, frictionally driving said tickets towards an outlet opening in said housing, and bending said group of tickets along one of said lines of weakness, issuing at least one ticket from said group through said outlet opening to a position in which it can be grasped by a person outside said housing, with said one ticket bent at a substantial angle so as to encompass a barrier member extending along said one line of weakness, thus presenting said ticket in a position to be pulled, while maintaining the bend at said one line, to facilitate tearing of said one ticket loose from the rest of the tickets in said group.

15. A method as in claim 14, including the step of bending said group along said one line of weakness prior to issuing said one ticket, said bending step comprising thrusting said group towards a barrier, causing said group to buckle and bend along said one line, and continuing to thrust said group towards said barrier while guiding said one ticket towards said outlet.

16. A method as in claim 15, including closing said outlet opening with gate means, opening said gate means to issue a ticket through said outlet opening, and closing said gate means to hold said group of tickets to prevent more than said one ticket from being withdrawn.

17. A method of dispensing tickets from a panel in which said tickets are delineated from one another by lines of weakness, said method comprising the steps of storing said tickets in a housing, issuing at least one ticket from said group through an outlet opening in said housing, with said one ticket bent at a substantial angle around a tearing barrier along one line of weakness, and holding the remaining tickets of said group in said housing, while maintaining the bend at said one line, to facilitate tearing of said one ticket loose from the rest of the tickets in said group, thrusting said group in a first direction towards a bending barrier to cause said panel to bend along one line of weakness, guiding the lead ticket ahead of said one line in a second direction at an angle to said first direction said second direction extending through said opening, said thrusting causing said lead ticket to issue from said machine.

18. A method as in claim 17, including thrusting and holding the remainder of said panel against said tearing barrier to hold said panel and facilitate tearing of said lead ticket free from said panel.

19. A ticket dispensing device, said device comprising, in combination, a housing, an outlet opening in said housing, frictional drive means for moving in a first direction a strip of tickets delineated by lines of perforations, a tearing barrier in said housing adjacent said opening, means for forming a bend by bending said panel along one of said lines of perforations to direct a first one of said tickets in a second direction forming a substantial angle with said first direction, and moving said first ticket out of said machine through said opening with said tearing barrier fitted into said bend and aligned with said one line of perforations and said first ticket extending into a position in which it can be grasped and pulled in said second direction to pull the next ticket against said tearing barrier while maintaining said bend and facilitating the tearing of said one ticket free from said strip along said one line of perforations.

20. A device as in claim 19, in which said curved guide comprises a plurality of curved members fastened together in spaced-apart relationship to one another.

21. A device as in claim 19, including gate means mounted for moving towards and away from said opening, and means for pushing said gate means and thereby pushing said first ticket towards said opening.

22. A device as in claim 21, in which said gate means holds said strip with said first line of perforations adjacent said barrier edge.

* * * * *